United States Patent [19]

Van Doorn et al.

[11] 3,985,072

[45] Oct. 12, 1976

[54] BALING CHAMBER CONSTRUCTION

[75] Inventors: Donald W. Van Doorn; Roy T. Williams; James B. Hawkins, all of Columbus, Ga.

[73] Assignee: Lummus Industries, Inc., Columbus, Ga.

[22] Filed: Jan. 17, 1975

[21] Appl. No.: 542,038

[52] U.S. Cl. ..... 100/255

[51] Int. Cl.[2] ..... B30B 15/04

[58] Field of Search ..... 100/255, 245, 246, 250, 100/252

[56] References Cited

UNITED STATES PATENTS

| | | | |
|---|---|---|---|
| 2,016,444 | 10/1935 | Mackenzie | 100/255 |
| 2,211,198 | 8/1940 | Christoph | 100/255 |
| 2,241,063 | 5/1941 | Grimes et al. | 100/255 |
| 2,420,413 | 5/1947 | Branson | 100/255 X |
| 2,503,354 | 4/1950 | Quinn | 100/255 X |
| 2,848,940 | 8/1958 | Jonsson | 100/255 |
| 2,961,943 | 11/1960 | Van Doorn | 100/255 |
| 3,130,665 | 4/1964 | Neitzel | 100/255 X |
| 3,252,409 | 5/1966 | Merkel et al. | 100/255 X |
| 3,548,744 | 12/1970 | Van Doorn | 100/255 |

*Primary Examiner*—Billy J. Wilhite

*Attorney, Agent, or Firm*—Jennings, Carter & Thompson

[57] ABSTRACT

A baling chamber for fibers and the like having a pair of side walls and a pair of end walls, one of the end walls being split vertically and with its halves pivotally mounted to the pivoted side doors. Linkage mechanism is associated with the split end door to cause its parts to move away from the bale and away from each other when the side doors are opened. The mechanism also includes improved means for locking the walls together, such as a floating locking bar carried by one of the side walls and disposed to engage the free end of one of the other walls. A contoured slot in a part of the wall causes the locking bar to assume proper locking and unlocking positions.

10 Claims, 12 Drawing Figures

BALING CHAMBER CONSTRUCTION

Our invention relates to apparatus for baling in which bales of fibers or the like may be formed, and more particularly relates to the construction of the baling chamber itself.

In the art to which this invention relates it is desirable to be able to use automatic strapping machinery for placing strapping about bales of fibers and the like while held under compression between platens. Also, it is customary in the art to cover bales of certain materials, such for instance as cotton and synthetic fibers, with wrapping of various kinds, prior to the strapping operation. In the conventional presses which ordinarily embody four separate doors it is difficult to provide the bale with longitudinal strapping. The reason for this is that the various door as heretofore mounted are in the way and do not permit the strapping mechanism to approach the bale in proper manner to place the straps thereabout. Furthermore, when dressing the platens with certain types of protective covering such as set up boxes, the conventional press requires the use of a considerable amount of effort and skill to place certain of these boxes or wrappings in place.

In view of the foregoing one of the prime objects of our invention is to provide baling chamber construction in which, when the bale is finished and while it is still under compression between the platens, all of the walls may be removed from the bale sufficiently to permit the efficient use of strapping mechanism, particularly mechanism which will place longitudinal straps about the bale.

Another object of our invention is to provide improved and simplified mechanisms for accomplishing the foregoing object, which mechanisms broadly stated embody means to pivotally mount certain of the side walls of the chamber, the end walls of the chamber being pivotally mounted on and articulated for movement with the side walls in such fashion that the chamber may be closed and locked in bale forming position and at the same time when open all the walls move away from the bale itself, leaving all four sides of the bale freely accessible.

Another object of our invention is to provide a baling chamber which is compatible with various types of wrapping and packaging materials and also which is compatible with various strapping patterns, namely, which may permit the application of straps longitudinally or transversely of the bale.

Another object of our invention is to provide a baling chamber mechanism in which the large side forces imposed upon the same by the compression of the bale are contained within the rectangular framework of the set of doors or walls themselves, eliminating the necessity of transmitting the forces through the framework of the press itself.

A further object is to provide apparatus of the character designated which readily lends itself to automation with respect to opening, closing and locking of the parts.

A further object of our invention is to provide locking mechanism for apparatus of the character designated which will assure that the mechanism remains locked even in the event of failure of the power actuated mechanism employed to automate the same.

Another object of our invention is to provide a baling chamber which may with equal facility be used with up-packing or down-packing presses, and with left and right-hand assemblies and furthermore which is symetrical about the longitudinal center line, thereby permitting the use of the same side walls and various other mechanisms on either side, without the necessity of fabricating them for right-hand or left-hand use.

Another object is to provide mechanism for locking the walls together, which mechanism, while being adequately strong to withstand the tremendous internal bale forces, nevertheless is so designed as to require relatively small amounts of power to move the same from locked to unlocked position, and vice versa.

Another object is to minimize the use of parts which slide one upon the other under high pressures, thus to reduce overall wear in the apparatus.

Apparatus illustrating features of our invention is shown in the accompanying drawings, forming a part of this application, in which.

Figure 3A:
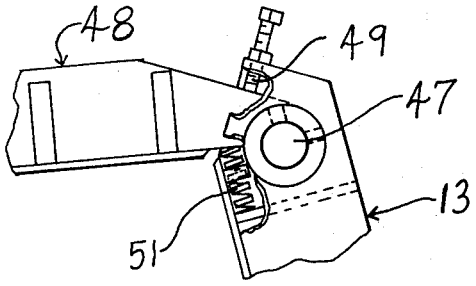
FIG. 3 is a somewhat diagrammatic view showing the parts in fully open position.
Figure 4:
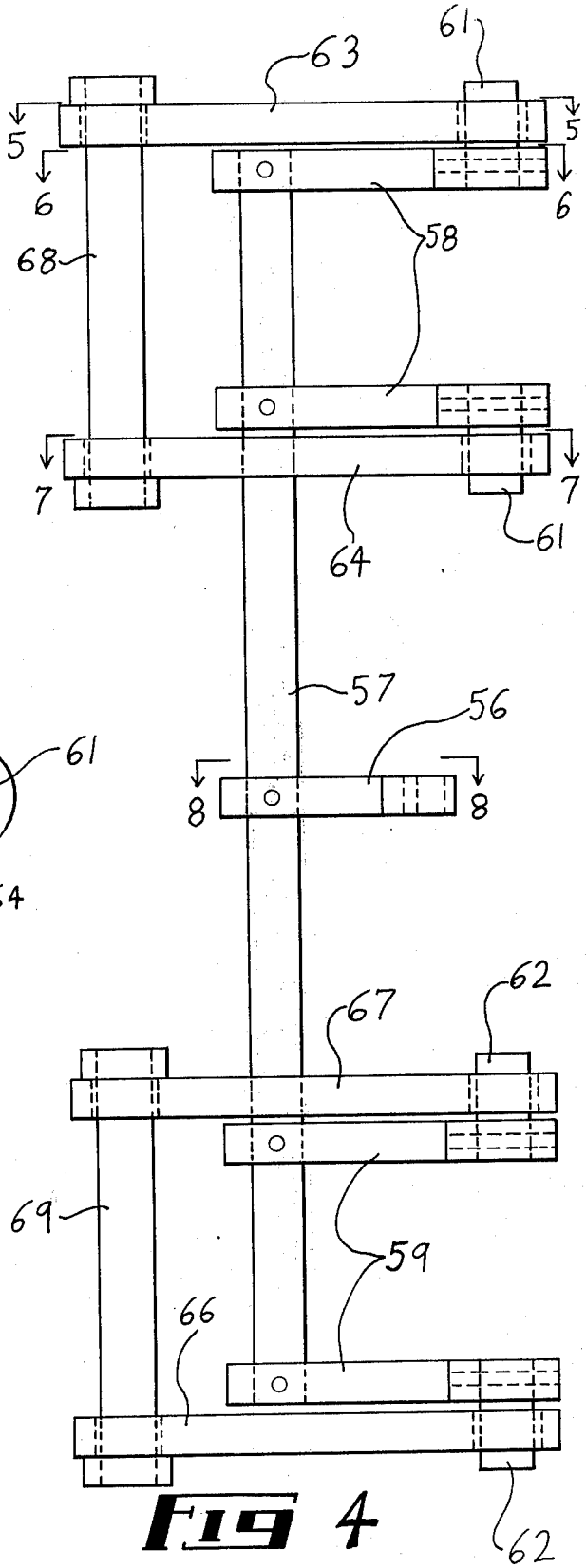
Figure 9:
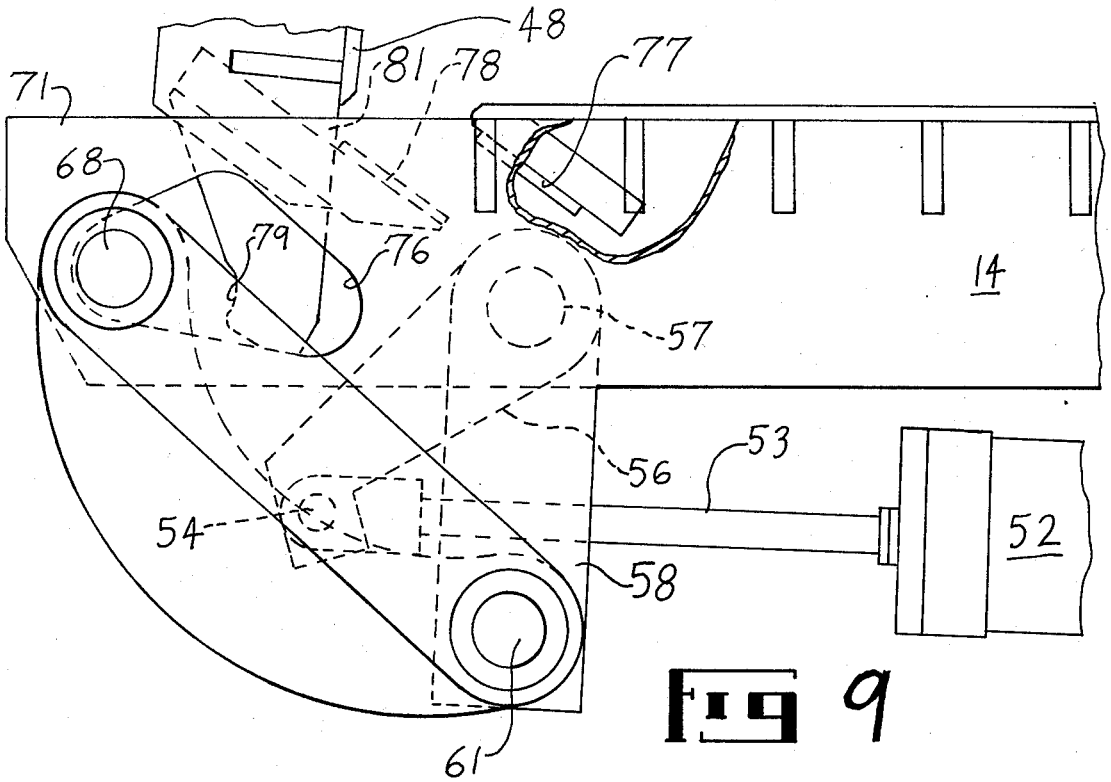
Figure 11:
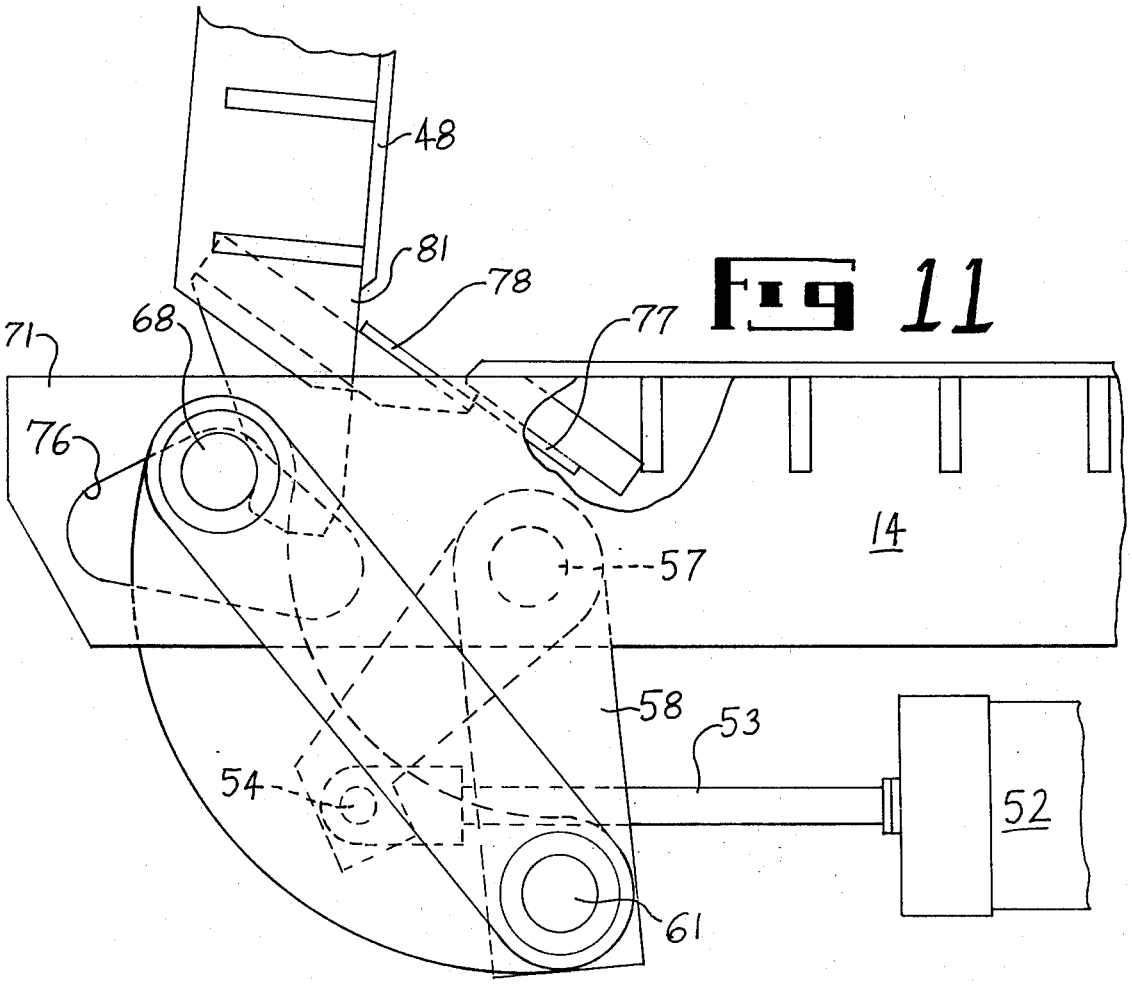
Figure 10:
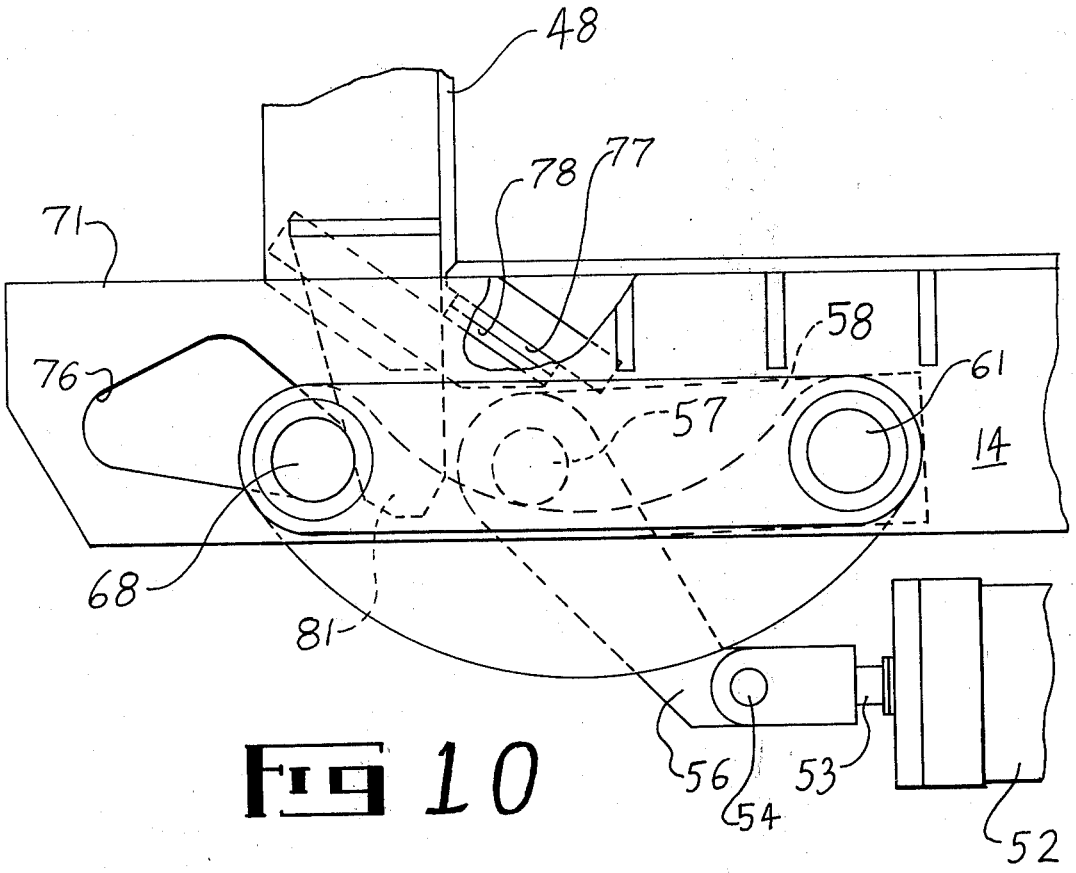

FIG. 3*a* is an enlarged detail fragmental view illustrating the stop and biasing means for the pivoted end wall of the chamber;

FIG. 4 is an enlarged detail side elevational view of the floating locking bars and control shaft and toggle linkage therefor;

FIGS. 5 through 8 inclusive are detail views taken generally along the respective lines as indicated on FIG. 4;

FIG. 9 is an enlarged detail fragmental plan view of the locking system with the doors substantially closed but prior to the actuation of the locking mechanism for the doors;

FIG. 10 is a view corresponding to FIG. 9 and showing the doors in fully locked position; and, FIG. 11 is a view corresponding to FIGS. 9 and 10 and illustrating the position of the parts substantially at the moment of the completion of unlocking of the doors.

Figure 1:
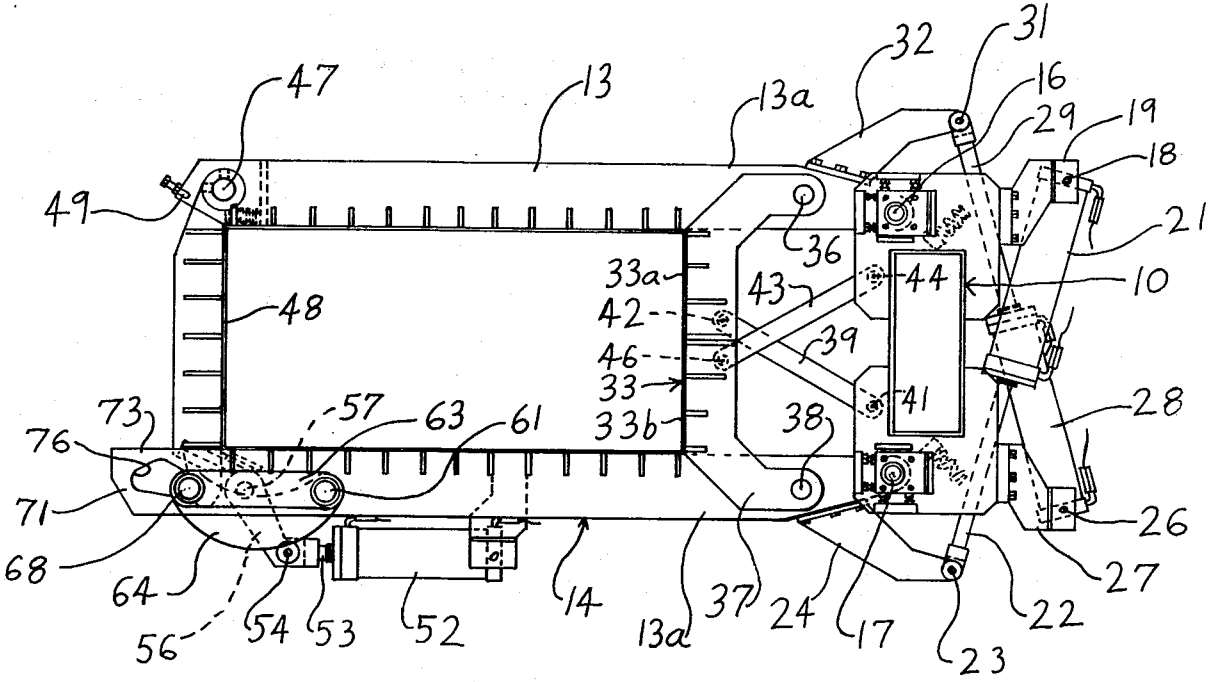
FIG. 1 is a plan view with the parts shown in fully locked, ready to bale position.
Figure 2:
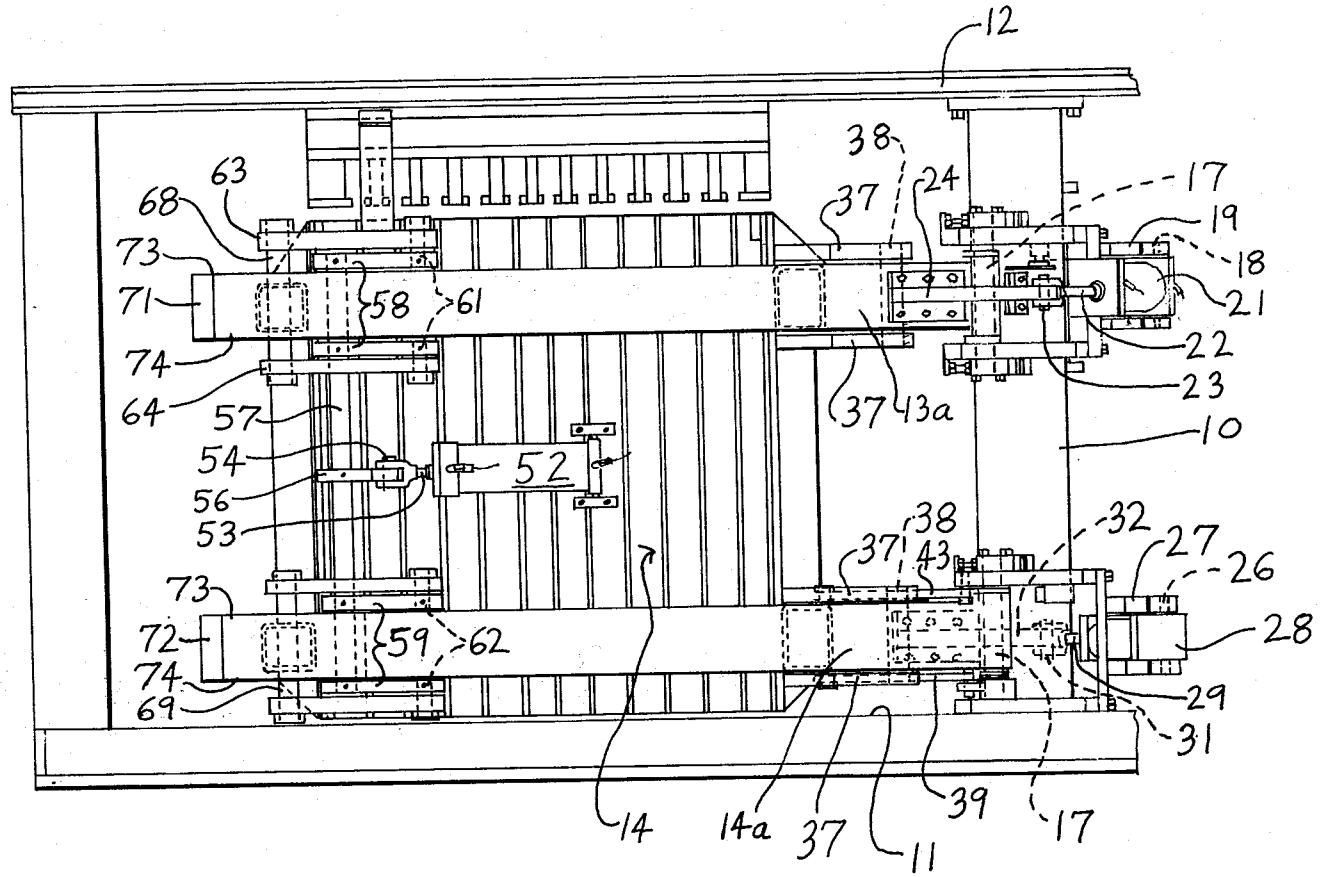
FIG. 2 is a side elevational view of the apparatus with the parts as shown in FIG. 1.
Figure 3:
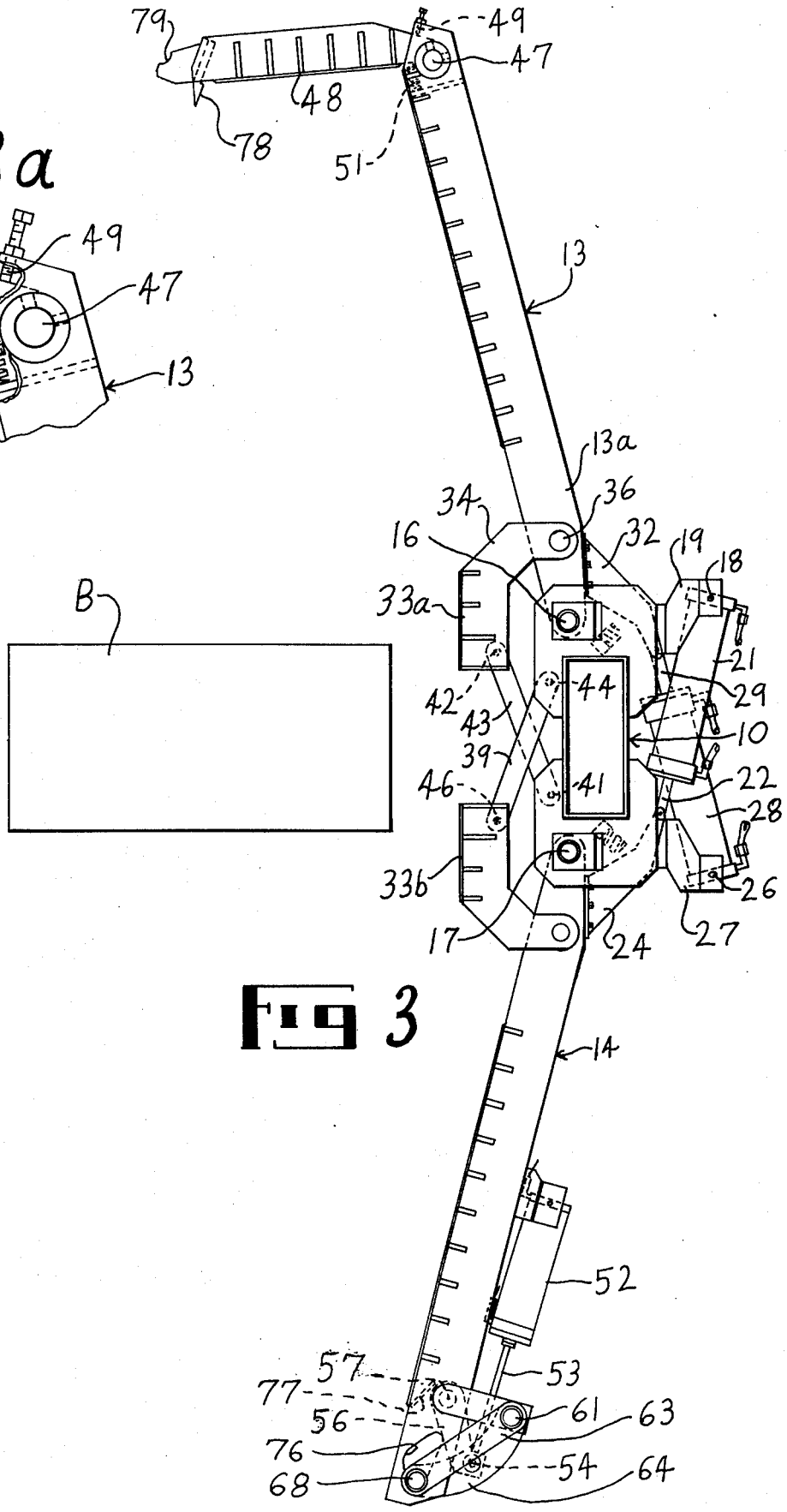
Figure 5:
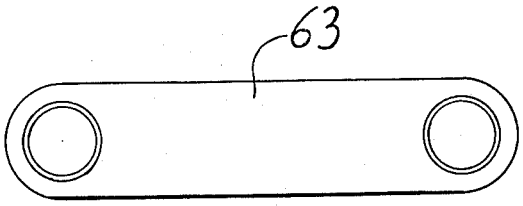
Figure 6:
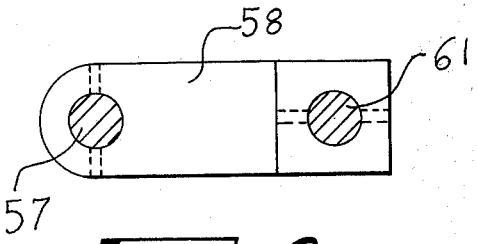
Figure 7:
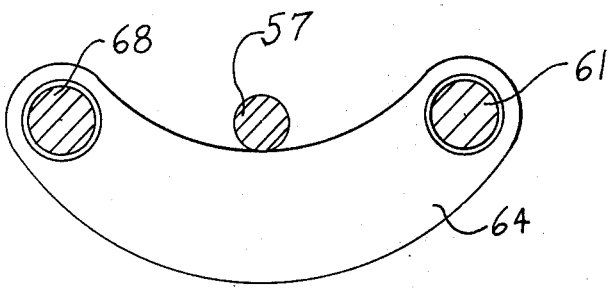
Figure 8:
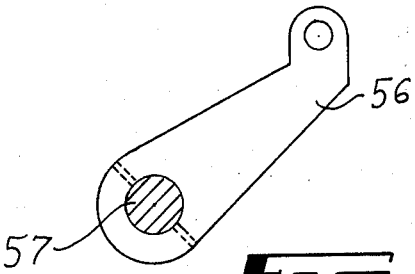

Referring now to the drawings for a better understanding of our invention and more particularly to FIGS. 1, 2 and 3 which show our improved apparatus as embodying a main supporting frame or column 10. The column 10 may be a fabricated structure which extends from the supporting floor 11 and may be anchored to an overhead structure indicated at 12. It is from this supporting structure 10 that side walls 13 and 14 are pivoted as indicated at 16 and 17, respectively. Viewing FIG. 2 it will be seen that there are in fact upper and lower sets of the pivots 16 and 17, only those relating to the wall 14 being shown in FIG. 2.

Pivotally mounted as at 18 to a suitable, heavy-duty bracket 19 is a fluid pressure cylinder 21. The piston rod 22 of the cylinder 21 is pivotally connected at 23 to a bracket 24 carried by the wall 14.

In similar manner, pivotally mounted at 26 to a heavyduty bracket 27 carried by the supporting structure 10 is another cylinder 28. The piston rod 29 of cylinder 28 is pivotally connected at 31 to a bracket 32 which is carried by the wall 13. As is shown in the drawings these cylinders are both double acting and fluid under pressure from a suitable source and under control of suitable valves, not shown, may be applied to the respective ends to cause the respective piston rods to move from the position shown in FIG. 1 to the position shown in FIG. 3, and vice versa. It will thus be apparent that the walls 13 and 14 may be moved, when the mechanism is unlocked as will be explained, from the position shown in FIGS. 1 and 2 to the full open position thereof shown in FIG. 3.

Adjacent the pivoted ends of the walls 13 and 14 we show an end wall indicated generally by the numeral 33. As best illustrated in FIG. 3 the end wall 33 is split vertically into two halves, $33^a$ and $33^b$.

The half $33^a$ of the end wall 33 carries upper and lower sets of brackets 34 which are pivoted at 36 to the upper and lower extended frame members $13^a$ of the door 13. In similar manner the half $33^b$ of the end wall 33 carries brackets 37 pivotally mounted at 38 to the horizontal, upper and lower extended frame members $14^a$ carried by the door 14.

A link 39 is pivoted at 41 to a stationary part of the supporting framework 10. The opposite end of link 39 is pivoted at 42 adjacent the free end of the section $33^a$ of the wall 33. In similar manner a link 43 has one end pivoted at 44 to a part of the stationary framework 10 and its opposite end is pivoted at 46 to the section $33^b$ of the end wall 33.

From what has been so far described it will be seen that when the side walls 13 and 14 pivot about their respective pivots 16 and 17 from the position of FIG. 1 to the position of FIG. 3 the sections $33^a$ and $33^b$ making up the end wall not only move away from each other, but also move away from the adjacent end of the bale B which has been formed while the parts were closed.

Mounted on a vertical shaft 47 on the free end of one of the walls, for instance 13, is an opposite end wall 48. The end wall 48 is free to pivot on its shaft from the position of FIG. 1 to the position shown in FIG. 3 at which time a stop member 49 is engaged by the wall 48 to prevent further clockwise pivoting movement as viewed in FIGS. 1 and 3. A spring 51 is mounted in position to bias the wall 48 against the stop whenever the parts are unlocked. See FIG. 3*a*. The purpose of this will later appear.

Mounted on the wall 14 is a double-acting fluid pressure cylinder 52 having a piston rod 53. The piston rod 53 is pivotally connected at 54 to an arm 56 which is carried by a vertically disposed shaft 57 mounted in suitable bearings adjacent the free end of the pivoted wall 14. See particularly FIG. 4.

Fast on the shaft 57 are links 58 and 59. Carried by the ends of the links 58 are pins 61 and carried by the links 59 are pins 62. Pivotally mounted about the pins 61 is an upper, straight link 63 and a lower curved link 64. See FIGS. 4, 5 and 7. In similar manner, secured to the pins 62 is a lower straight link 66 corresponding to link 63 and an upper, curved link 67 corresponding to link 64.

Mounted on the outer ends of the links 63 and 64 is an upper, floating locking bar 68. Mounted on the outer ends of the links 66 and 67 is a lower, floating locking bar 69.

From what has just been described it will be seen that when the cylinder 52 oscillates or rocks the shaft 57 through the arm 56, locking bars 68 and 69 are free to move, in effect, toward and from the shaft 57.

Viewing FIGS. 1, 9, 10 and 11 it will be seen that the wall 14 which carries the cylinder 52 is provided with upper and lower extensions 71 and 72. These are in the form of side beams which add strength to the wall and which may be made up of horizontal plate members 73 and 74.

The plate members 73 and 74 are provided with vertically aligned, contoured slots or openings of the shape shown to larger scale in FIGS. 9, 10 and 11 as indicated by the numeral 76. The locking bars 68 and 69 extend through the slots in the extending beam members 71 and 72, respectively, as shown in FIG. 2 so that the locking bars are held loosely captive by said slot arrangement.

Carried by the fabricated beams 71 and 72 of the wall 14 are cam plates 77. As shown in the enlarged views, FIGS. 9, 10 and 11, these plates are placed at an angle to the longitudinal axis of the wall 14.

Secured to the wall 48, adjacent its free end, are upper and lower cam plates 78 which are adapted as will appear to engage with and slide against the plates 77 when the parts are brought into final closing position. The free end of the wall 48 carries notches 79 in an extension member 81 which also carries the plates 78.

Keeping in mind the foregoing description of the construction of our improved baling chamber the operation and advantages of the same may now be more readily explained and understood. With the parts in the position of FIGS. 1, 2 and 10 it will be seen that the pivoted wall 48 has been pulled by the locking bars 68 and 69 to locking position and that in this position due to the toggle arrangements connecting the shaft 57 the locking bars 68–69 and the linkages 58 and 59 form an over center, toggle lock. That is to say, as viewed in plan, FIG. 10, a line connecting the center of the floating locking bar 68 and the pin 61 lies inwardly just past the center of shaft 57. In this fashion when the mechansim is locked a failure of power or even a failure of the cylinder 52 itself will not cause the baling chamber to come unlocked.

Starting with the parts in the position of FIG. 10, let it be assumed that it is desired to unlock the baling chamber. Cylinder 52 is actuated, moving its piston rod to the left as viewed in the several figures. The first action is for the parts to move substantially to the position of FIG. 11, this being the position wherein the locking bars 68 and 69 have moved to the left as viewed in FIG. 11, it being remembered that the end wall 48 is biased by the spring 51 to pivot clockwise about the shaft 47. The notches 76 in the plate members of the door 14 are contoured so that the floating locking bars 68 and 69, in response to rotation of shaft 57, can move from the position of FIG. 10 to the position of FIG. 11. At this point the cam plates 77 and 78 are just about to become disengaged. It will be noted that the locking bars are engaging in the slots 79 of the extension member 81 carried by the end wall 48.

Viewing FIG. 9, it will be seen that further clockwise rotation of shaft 57, from the position of FIG. 11, causes the locking bars to move from their positions relative to the slot 76 as shown in FIG. 11 to the position thereof as shown in FIG. 9. Remembering now that the stop 49 prevents the free end of the wall 48 from moving any farther to the left as viewed in FIG. 9 and as shown in that Figure, it will be seen that the locking bars have moved away from the notches 79 and that the plate 78 has moved out of the projected path of plate 77. The mechanism may be now completely opened by actuating the cylinders 21 and 28, thus moving the parts to the position of FIG. 3. Obviously, upon initial closing the parts also occupy the position of FIG. 9 so that plate 77 is out of the path of plate 78 and so that the notches 79 may enter behind the locking bars 68 and 69.

It will be particularly noted that it is the contour of the notches 76 which determines the position of the locking bars in response to rotation of shaft 57. That is to say, when the parts are in position either for initial closing or final opening, the contour of the notches 76 dictates that the locking bar 68 will ride into the corner thereof as shown in FIG. 9. Similarly, when the shaft 57 is rotated counterclockwise, whereupon the locking bars engage in the notches 79 and the parts are brought to the full closed position shown in FIG. 10, the contour of the notches 76 dictates that the locking bars will lie in that portion of the notches as shown in FIG. 10.

In view of the foregoing it will be seen that we have devised an improved mechanism for forming a baling chamber which may be used, in association with known and standard mechanisms for baling therein materials such as cotton, man-made fibers, and various other materials. It will also be particularly noted that when in open position all of the walls of the baling compartment are free and clear of the bale B so that automatic strapping machinery, including strap feeding devices and the necessary chutes, may be brought into position so that straps may be placed not only transversely of the bale which has been formed, but also longitudinally of the same. Our invention thus is particularly applicable to those baling installations wherein it is desired to strap the bale with automatic strapping devices.

It will further be noted that due to the arrangement of the parts very little power is required to move the parts from full locked to unlocked position, and vice versa. At the same time the construction shown and described permits these parts to be rugged enough to withstand the tremendous forces due to the compression of the material within the chamber. Additionally, it will be noted that except for placing in tension the main column 10 between the pivot points 16 and 17 no other part of any framework is called upon to carry any part of the tremendous loads imposed, such loads being carried by the walls.

While we have shown our invention in but one form, it will be obvious to those skilled in the art that it is not so limited but is susceptible of various changes and modifications without departing from the spirit thereof.

What we claim is :

1. In a baling chamber for fibers and the like,
   a. a main supporting structure,
   b. a pair of side walls pivotally associated with the supporting structure and disposed when closed to form opposite sides of the chamber,
   c. an end wall pivotally mounted adjacent the free end of one of the side walls and disposed when closed to form one end of the chamber,
   d. a wall for the opposite end of the chamber split into two sections, said sections being pivotally mounted to the side walls intermediate the pivoted and free ends thereof, and
   e. linkages pivotally connected to the split sections of said end wall and to the supporting structure, whereby upon opening the side walls the sections of said split end wall move away from each other.

2. In a baling chamber for fibers and the like,
   a. a main supporting structure,
   b. a pair of side walls pivotally associated with said supporting structure and disposed when closed to form opposite walls of the chamber, c. a wall for the end of the chamber nearest the pivoted ends of the side walls, which wall is split into two sections, said sections being pivotally mounted to the side walls intermediate the pivoted and free ends thereof,
   d. linkages pivotally connected to the split sections of said end wall and to the supporting structure, whereby upon opening the side walls the sections of said split end wall move away from each other,
   e. means forming a wall for the chamber at the end thereof opposite the split wall section, and
   f. means to hold the walls assembled, thereby to permit the packing of fiber and the like into the space defined by said walls.

3. Apparatus for forming a baling chamber comprising:
   a. a supporting structure,
   b. a pair of side walls pivotally connected to the supporting structure and disposed when closed to form opposite sides of the baling chamber,
   c. an end wall pivotally mounted to and carried adjacent the free end of one of said pivoted side walls and disposed when the side walls are in closed position to form an end of the baling chamber,
   d. means limiting the pivoting movement of the end wall in the opening direction,
   e. means biasing said pivoted end wall toward opening position,
   f. locking mechanisms carried by the free end of the other of said pivoted side walls adapted to cooperate with mechanisms carried by the free end of said end wall to lock said end wall and said side walls together, and
   g. means forming an opposite end wall for said chamber.

4. Apparatus as defined in claim 3 in which there are cooperating cam surfaces on the cooperating ends of said pivoted end wall and said side wall carrying said locking mechanism, said biasing means and said stop means on the pivoted end wall being effective to cause the cam surfaces on the free end of said pivoted wall to assume a position to pass into overlapping and engaging position relative to the cam surface on the side wall as the side walls are moved to closed position, means forming a part of the mechanism carried by said side wall to draw the free end of the said pivoted end wall toward final closed position, thereby engaging the cam surfaces, and means to lock the parts in closed position.

5. Apparatus as defined in claim 4 in which said means to lock said parts in said closed position comprise an over center toggle mechanism.

6. Apparatus as defined in claim 3 in which said locking mechanism includes a floating locking bar disposed to engage the free end of said pivoted end wall, and means holding the locking bar loosely captive to assure proper engagement of the locking bar with the end of said pivoted end wall upon closing of the chamber side walls, and mechanism connected to said locking bar to move the same and hence the free end of said end wall into final, chamber forming, closed position.

7. Apparatus as defined in claim 6 in which said means holding said locking bar loosely captive comprises a slot adjacent the free end of said side wall through which the locking bar extends, said slot being so contoured as to support the locking bar in position for proper locking engagement with the free end of the said pivoted end wall, and being so further contoured as to permit free movement of said locking bar upon final, closing movement of the parts.

8. In apparatus for locking the free ends of a pair of cooperating, pivoted walls of a baling chamber or the like, a. cooperating cam members carried adjacent the free ends of said walls, b. a floating locking bar and supporting mechanism therefor carried by one of said walls adjacent its free end and disposed to engage the free end of the other wall, c. means holding the locking bar when the parts are open in position to permit said cam surfaces to come together, whereby the free end of said other wall may be then engaged by said floating locking bar, d. an oscillatable shaft carried adjacent the free end of the wall carrying said locking bar, and e. over center toggle mechanism operatively connected between said shaft and said floating locking bar effective upon oscillation of said shaft to move the locking bar to door locking position and to lock the parts in said position.

9. Apparatus as defined in claim 8 in which there is power driven mechanism carried by the said pivoted wall which carries the locking bar and said shaft and which is operatively connected to move the parts as stated.

10. A baling chamber for forming bales of fiber and the like wherein all of the walls of the same are retractable from bale chamber forming position to a position clear of the bale which has been formed, thereby to permit strapping mechanisms to place straps about the bale which has been formed, comprising, a. a main supporting structure, b. a pair of side walls for the chamber pivotally mounted to the supporting structure, c. an end wall divided into at least two sections, said sections being pivotally mounted to the side walls intermediate the pivoted and free ends of the side walls, d. linkages pivotally connected to the split sections of said end wall and to the supporting structure, whereby upon opening the side walls the sections of said split end wall move away from each other and away from the bale, e. an opposite end wall pivotally mounted adjacent the free end of one of the side walls, and f. locking mechanism carried adjacent the free end of the other of said side walls and disposed to engage mechanisms carried by the free end of said other end wall, thereby to lock all of said doors together, said parts being constructed and arranged when in open position to move clear of the bale, permitting strapping mechanism to place straps about the bale.

* * * * *